US008991781B2

(12) United States Patent
Johnson et al.

(10) Patent No.: US 8,991,781 B2
(45) Date of Patent: Mar. 31, 2015

(54) PRODUCT DISPLAY FIXTURE

(75) Inventors: Jason W. Johnson, Wayzata, MN (US); Erin L. Zobel, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 288 days.

(21) Appl. No.: 13/550,934

(22) Filed: Jul. 17, 2012

(65) Prior Publication Data

US 2014/0021315 A1 Jan. 23, 2014

(51) Int. Cl.

| | |
|---|---|
| ***A47G 19/08*** | (2006.01) |
| ***A47G 19/02*** | (2006.01) |
| ***A47F 7/00*** | (2006.01) |
| ***A47B 96/07*** | (2006.01) |
| ***A47F 5/00*** | (2006.01) |
| ***A47G 1/16*** | (2006.01) |

(52) U.S. Cl.

CPC ..... *A47F 7/0064* (2013.01); *A47F 7/00* (2013.01); *A47F 7/0042* (2013.01); *A47B 96/07* (2013.01); *A47F 5/0006* (2013.01); *A47G 1/1646* (2013.01); *Y10S 248/906* (2013.01)

USPC ..... 248/644; 248/200.1; 248/448; 248/449; 248/451; 248/298.1; 248/229.12; 248/223.41; 248/906; 248/346.07; 248/176.3; 248/343; 248/244; 248/295.11; 248/323; 248/326; 211/41.1; 211/41.2; 403/109.1

(58) Field of Classification Search

CPC ..... A47F 7/00; A47F 7/0042; A47F 7/0064; A47B 96/07

USPC ..... 248/644, 200.1, 448, 449, 451, 298.1, 248/229.12, 223.41, 906, 224.51, 346.07, 248/176.3, 343, 244, 295.11, 323, 326; 403/109.1; 211/41.1–41.2

See application file for complete search history.

(56) References Cited

U.S. PATENT DOCUMENTS

| | | | | | |
|---|---|---|---|---|---|
| 959,735 | A | * | 5/1910 | Hancock | 248/477 |
| 1,071,428 | A | * | 8/1913 | Jones | 248/448 |
| 1,085,999 | A | | 2/1914 | Smith | |
| 1,184,246 | A | | 5/1916 | Klein | |
| 1,209,582 | A | | 12/1916 | Hoernegel | |
| 2,316,389 | A | * | 4/1943 | Atkinson | 248/300 |

(Continued)

OTHER PUBLICATIONS

Office Action from Canadian Patent Application No. 2,794,836, mailed Mar. 1, 2013 (3 pages).

*Primary Examiner* — Christopher Garft

(74) *Attorney, Agent, or Firm* — Leanne Taveggia Farrell; Westman, Champlin & Koehler, P.A.

(57) ABSTRACT

A display fixture includes a fixed component including a product receiving portion and an elongated spine portion, a first adjustable component insertably engaged with the elongated spine portion and including a product receiving portion and an adjustment portion, a second adjustable component insertably engaged with the elongated spine portion and including a product receiving portion and an adjustment portion, a third adjustable component insertably engaged with the elongated spine portion and including a product receiving portion and an adjustment portion. The first adjustable component operates to slidably adjust a distance between the product receiving portion of the fixed component and the product receiving portion of the first adjustable component, while the second adjustable component and the third adjustable component operate to slidably adjust a distance between the product receiving portion of the second adjustable component and the product receiving portion of the third adjustable component.

14 Claims, 9 Drawing Sheets

(56) References Cited

U.S. PATENT DOCUMENTS

| | | | | |
|---|---|---|---|---|
| 3,104,491 | A | | 9/1963 | Sparkman |
| 3,140,558 | A | | 7/1964 | Cassidy |
| 3,380,698 | A | | 4/1968 | Goldberg et al. |
| 4,223,864 | A | | 9/1980 | Harlow |
| D266,461 | S | | 10/1982 | Helzer |
| 4,364,537 | A | | 12/1982 | Helzer |
| 4,457,484 | A | | 7/1984 | Hameister |
| 4,473,207 | A | | 9/1984 | Nascher |
| 4,723,747 | A | * | 2/1988 | Karp et al. ..... 248/298.1 |
| D311,130 | S | | 10/1990 | Whitaker |
| 5,678,799 | A | * | 10/1997 | Jorgensen et al. ..... 248/343 |
| 7,419,129 | B2 | | 9/2008 | Kixmoeller |
| 7,434,699 | B2 | | 10/2008 | Stukenberg |
| 7,673,759 | B2 | | 3/2010 | Stukenberg |

* cited by examiner

PRODUCT DISPLAY FIXTURE

BACKGROUND

Display fixtures in a retail store organize and present products or merchandise to customers for purchase. Dinnerware is one exemplary type of product presented in retail stores for purchase. Dinnerware, such as a plate, comes in a wide variety of colors, shapes and sizes. For example, plates can be round, oval, square, rectangular and the like. In addition, dinnerware is susceptible to inadvertent breakage upon being handled. Therefore, it is desirable to provide a display fixture for dinnerware that mitigates potential damage, while also providing easy viewing.

The discussion above is merely provided for general background information and is not intended to be used as an aid in determining the scope of the claimed subject matter.

SUMMARY

A display fixture includes a fixed component including a product receiving portion and an elongated spine portion, a first adjustable component insertably engaged with the elongated spine portion and including a product receiving portion and an adjustment portion, a second adjustable component insertably engaged with the elongated spine portion and including a product receiving portion and an adjustment portion, a third adjustable component insertably engaged with the elongated spine portion and including a product receiving portion and an adjustment portion. The adjustment portion of the first adjustable component operates to slidably adjust a distance between the product receiving portion of the fixed component and the product receiving portion of the first adjustable component, while the adjustment portion of the second adjustable component and the adjustment portion of the third adjustable component operate to slidably adjust a distance between the product receiving portion of the second adjustable component and the product receiving portion of the third adjustable component.

The elongated spine portion includes a first channel and a second channel with the first channel substantially perpendicular to the second channel. The adjustment portion of the first adjustable arm is received by the first channel and a distal end of the first adjustment arm includes the product receiving portion. The adjustment portions of the second adjustable arm and the third adjustable arm each include a tooth for slidably engaging with each other and are received by the second channel. Distal ends of the second adjustable arm and the third adjustable arm include the product receiving portions.

To adjust the display fixture to accommodate different sized products a method includes loosening a fastener that couples the first adjustable component, the second adjustable component and the third adjustable component to the fixed component. The first adjustment portion of the first adjustable component is slid relative to the elongated spine portion to adjust the first distance between the product receiving portion of the fixed component and the product receiving portion of the first adjustment portion. The adjustment portion of the second adjustable component is slid relative to the adjustment portion of the third adjustable component and the adjustment portion of the third adjustable component is slid relative to the adjustment portion of the second adjustable component to adjust a second distance between the product receiving portion of the first adjustable component and the product receiving portion of the second adjustable component. The fastener is tightened to couple the first adjustable component, the second adjustable component and the third adjustable component to the fixed component.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein include a display fixture for mounting to a crossbar of a display unit, such as a gondola display unit, located in a retail store. The display fixture includes a fixed base for receiving a bottom edge of a piece of dinnerware, a pair of adjustable substantially horizontal arms interconnected with the base for retaining sides of a piece of dinnerware and an adjustable substantially vertical arm for retaining a top edge of the piece of dinnerware. The adjustable substantially horizontal arms and adjustable substantially vertical arm provide the display fixture with the ability to retain a variety of different shapes and sizes of dinnerware in a substantially vertical orientation.

Figure 1:
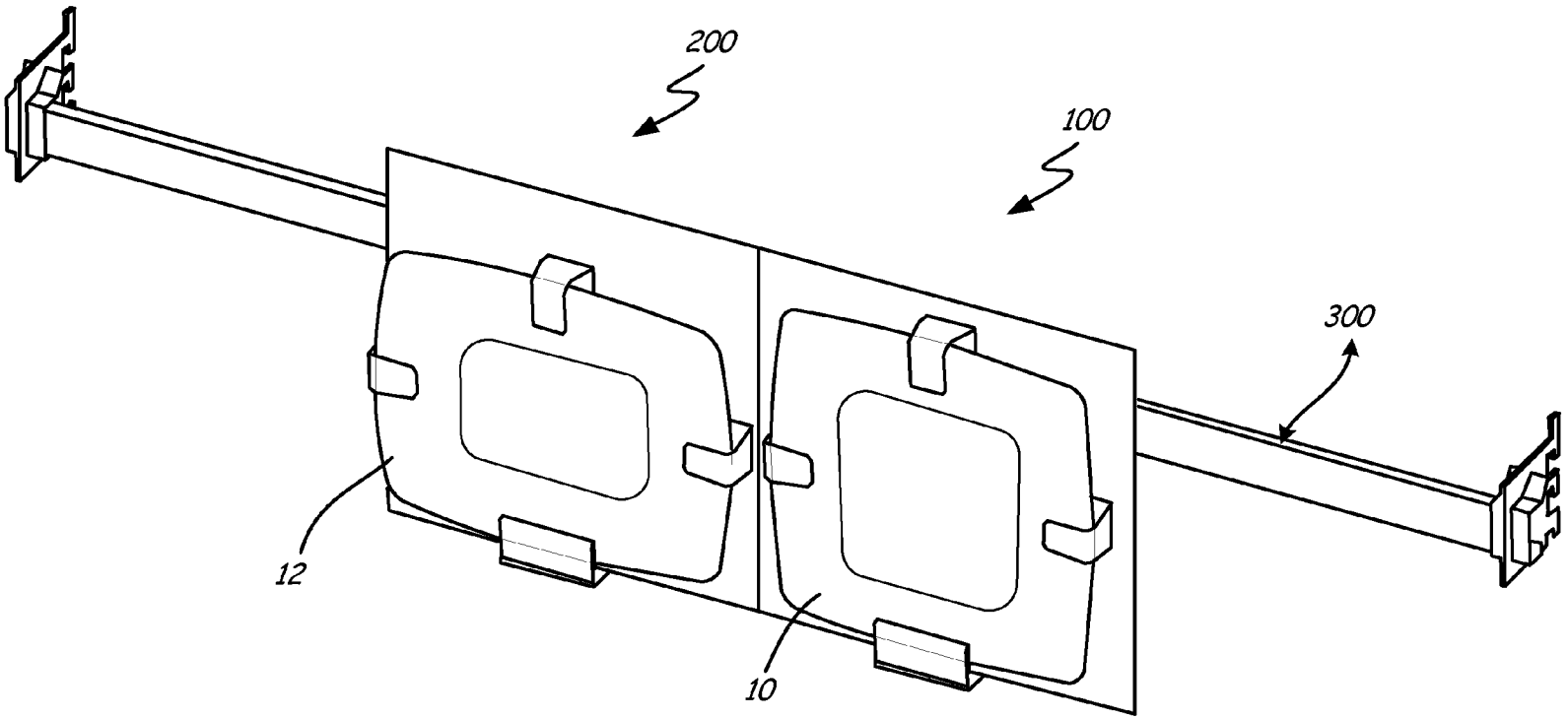
FIG. 1 illustrates two product display fixtures located side-by-side and retaining different shaped pieces of product according to one embodiment.

FIG. 1 illustrates two product display fixtures 100 and 200 located side-by-side and retaining two different shaped pieces of dinnerware according to one embodiment. Each product display fixture 100 and 200 is mounted to a crossbar 300 for mounting to a display unit. More particularly, each product display fixture 100 and 200 is configured to retain a dish 10 and 12, such as a dinner plate, salad plate, dessert plate, soup bowl, a serving bowl, a serving plate or the like, in a substantially vertical orientation. In this position, not only are customers and purchasers able to easily view dinnerware for style, size, pattern, color, thickness, quality, shape, and the like, but customers and purchasers are also able to evaluate a hands-on look and feel of the dinnerware while decreasing the risk of breakage.

In the embodiment illustrated in FIG. 1, each product display fixture 100 and 200 is mounted to a crossbar 300, which can be mounted to uprights of a display unit. Although FIG. 1 illustrates only two product display fixtures 100 and 200 mounted to crossbar 300, it should be realized that one or more product display fixtures 100 and 200 can be mounted to crossbar 300. In addition, any number of crossbars 300 can be mounted to a display unit to expand the number of product display fixtures 100 and 200 that can be mounted for display on a single display unit. Still further, product display fixtures 100 and 200 can mount to a display unit in other ways. For example, product display fixtures 100 and 200 can hang from a back panel of a display unit using peg hooks and the like.

Figure 2:
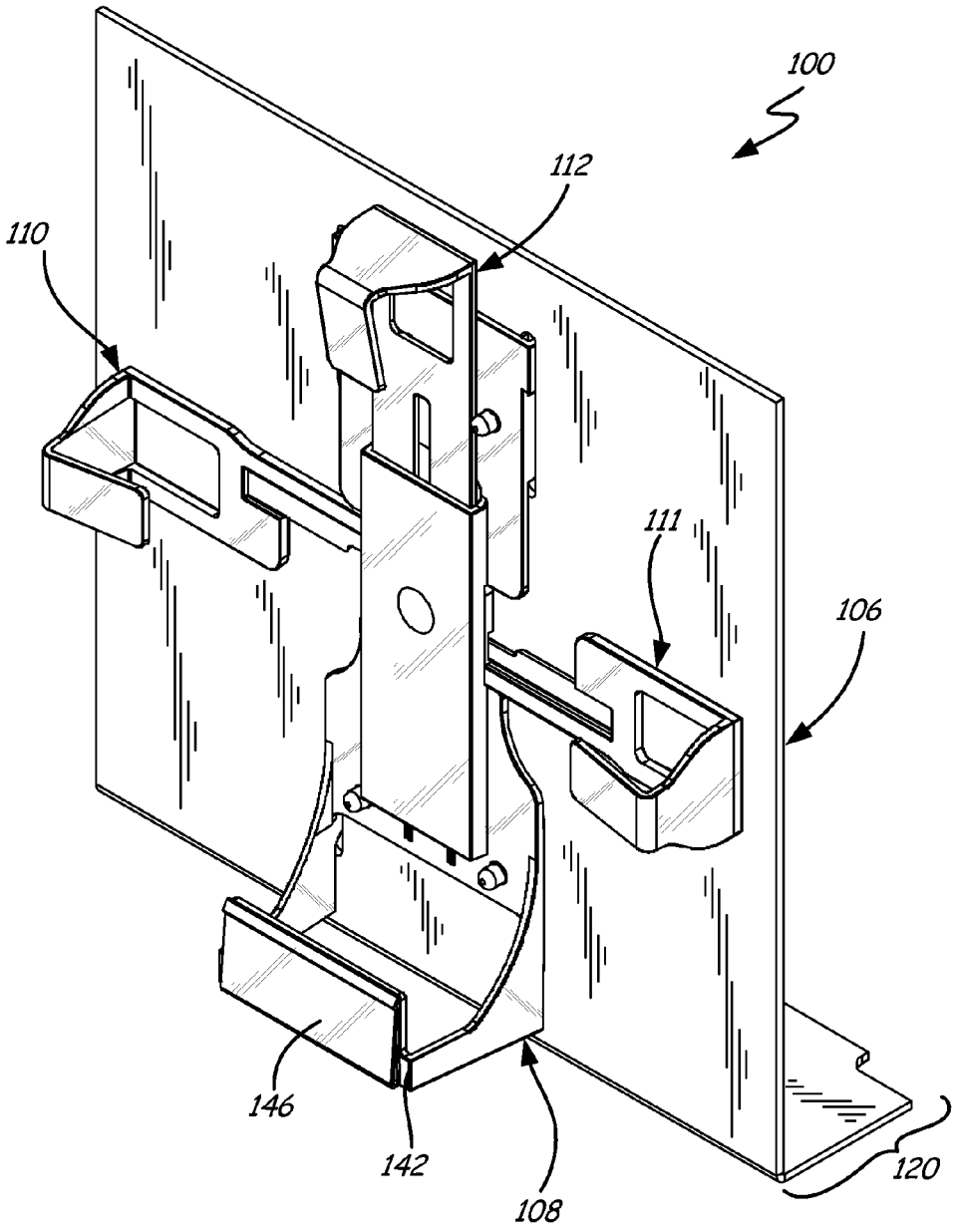
FIG. 2 is a perspective view of one of the product display fixtures of FIG. 1 with the piece of dinnerware removed.
Figure 3:
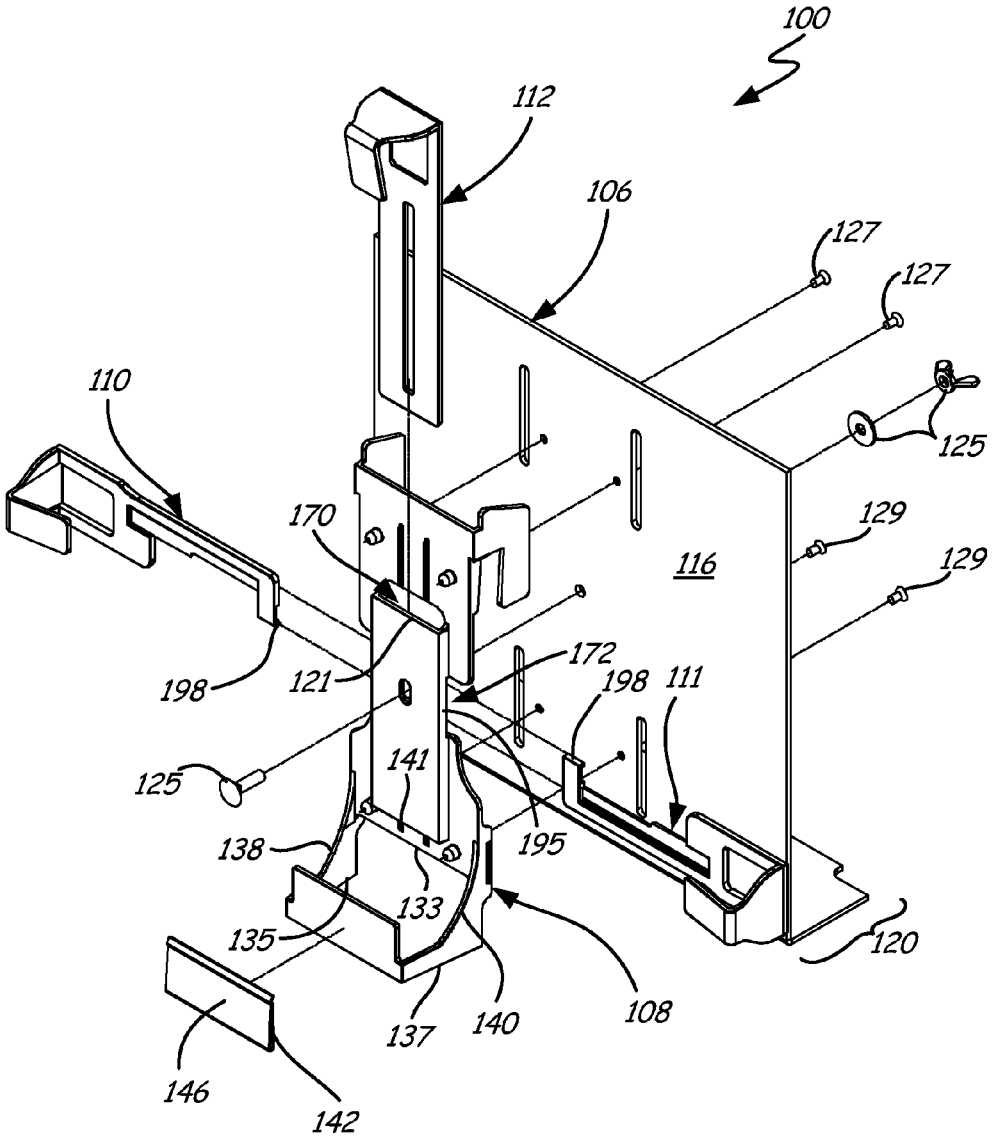
FIG. 3 illustrates an exploded perspective view of the product display fixture illustrated in FIG. 2.

FIG. 2 illustrates a perspective view of one of the product display fixtures 100 of FIG. 1 with dish 10 removed for clarity and FIG. 3 illustrates an exploded view of FIG. 2. As illustrated, product display fixture 100 includes a backer 106, a base 108, a pair of substantially horizontal arms 110 and 111 and a substantially vertical arm 112. Substantially vertical arm 112 and the pair of substantially horizontal arms 110 and 111 can also be described as a first adjustable component 112, a second adjustable component 110 and a third adjustable component 111. Backer 106, base 108, substantially horizontal arms 110 and 111 and substantially vertical arm 112 interconnect or are assembled together to form product display fixture 100 that can accommodate a variety of sizes and shapes of dinnerware.

Figure 4:
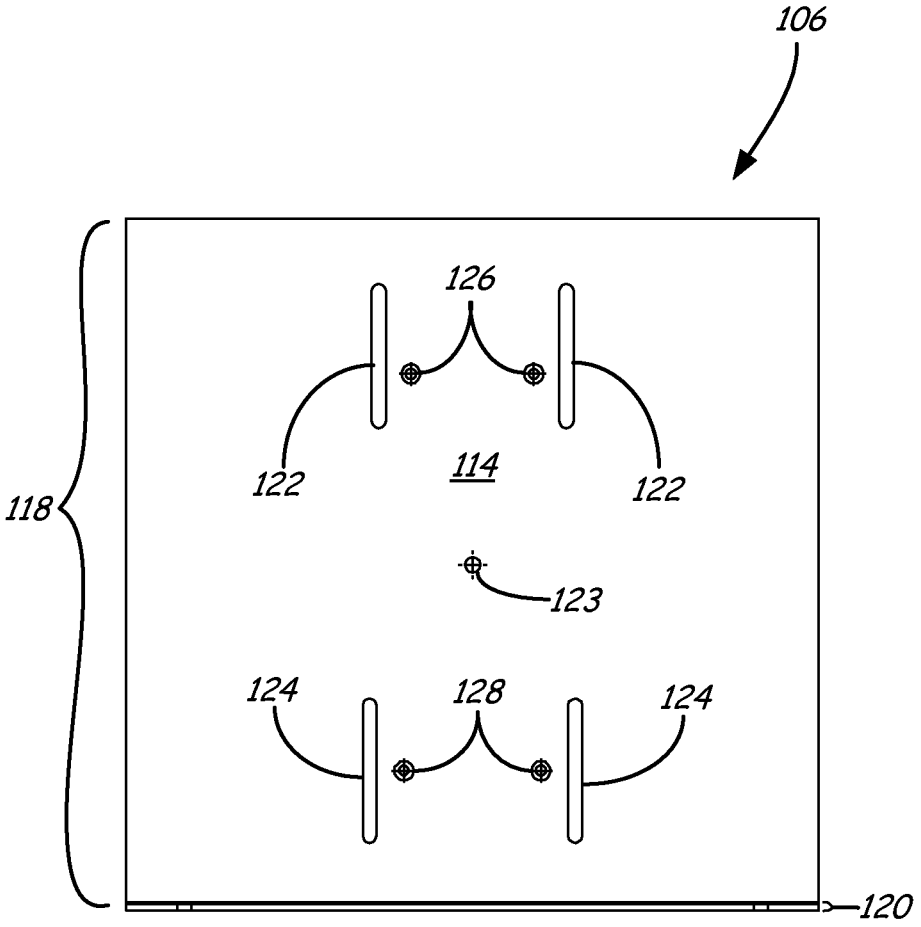
FIG. 4 is a back view of a backer of the product display fixture illustrated in FIGS. 2 and 3.

FIG. 4 illustrates a back view of one embodiment of backer 106. Backer is adapted to or configured to support base 108, the pair of substantially horizontal arms 110 and 111 and substantially vertical arm 112 away from a back panel of a display unit, such as a gondola display unit. Backer 106 is made of a sheet material and includes screen printed back and front surfaces 114 and 116 (FIG. 3). For example, back and front surfaces 114 and 116 can include a wood grain screen printing. Backer 106 includes main member 118 and a spacer member 120 (FIGS. 2 and 3). Main member 118 includes a pair of upper through slots 122, a pair of lower through slots 124, a pair of upper holes 126, a pair of lower holes 128 and a centrally located hole 123. Slots 122 and 124 and holes 123, 126 and 128 extend entirely through main member 118. Upper holes 126 are located between upper through slots 122 and lower holes 128 are located between lower through slots 124. Upper and lower through slots 122 and 124 receive portions of base 108. Upper and lower holes 126 and 128 receive fasteners 127 and 129 (FIG. 3) for fastening base 108 to backer 106. Centrally located hole 123 is configured to receive a multi-functional fastener 125 (FIG. 3) that among other functions fastens base 108 to backer 106. Multi-functional fastener 125 will be discussed in more detail below.

Figure 5:
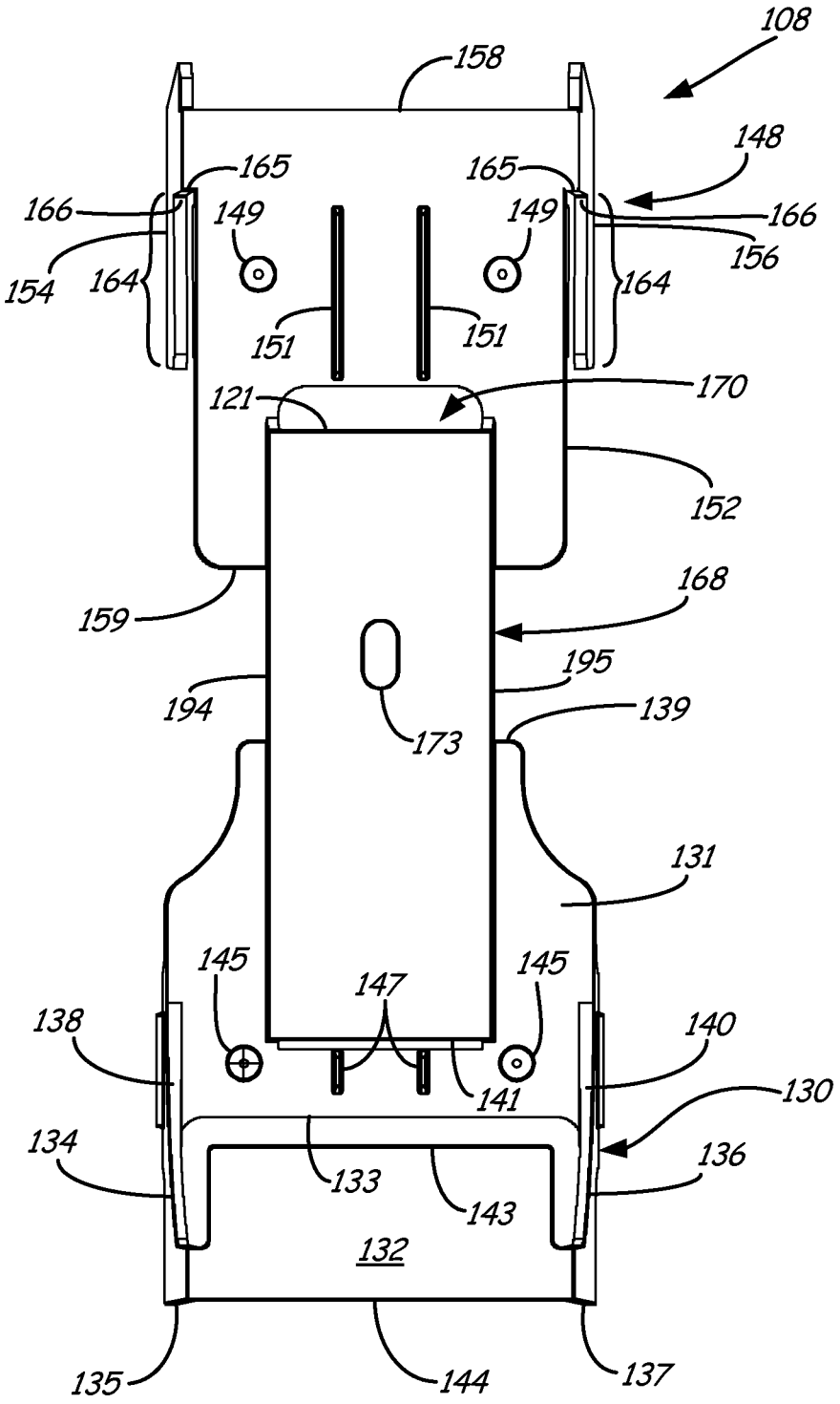
FIG. 5 illustrates a front view of a base of the product display fixture illustrated in FIGS. 2 and 3.
Figure 6:
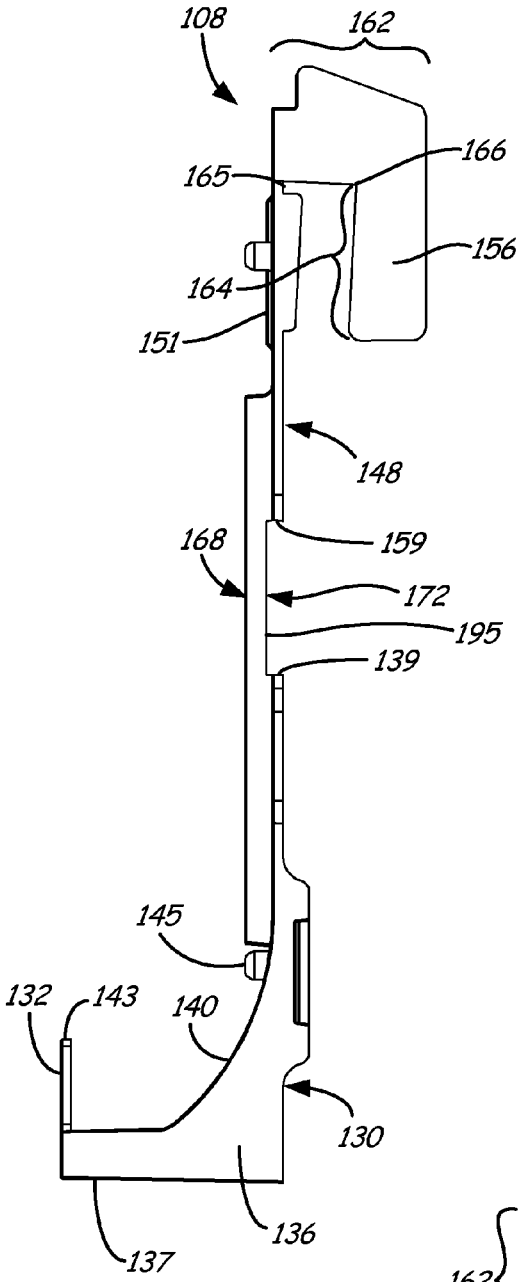
FIG. 6 illustrates a side view of FIG. 5.
Figure 7:
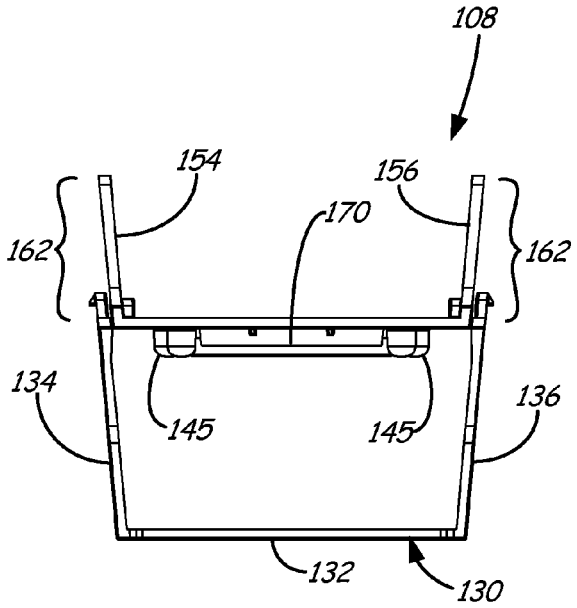
FIG. 7 illustrates a top view of FIG. 5.

FIG. 5 illustrates a front view, FIG. 6 illustrates a side view and FIG. 7 illustrates a top view of one embodiment of base 108. Base 108 is a fixed component that is fixed to backer 106 via fasteners 127 and 129 and includes a product receiving portion 130 for receiving an edge of a product, a mounting portion 148 for mounting to backer 106 and a display unit and an elongated spine or channel portion 168 for receiving and supporting the pair of substantially horizontal arms 110 and 111 and substantially vertical arm 112.

As described, product receiving portion 130 supports an edge of a product, such as a bottom edge of a piece of dinnerware, and includes a back wall 131, a front wall 132 and a pair of first and second side walls 134 and 136. In one embodiment, back wall 131, front wall 132, first side wall 134 and second side wall 136 are each substantially planar. Front wall 132 includes a bottom edge 144, an upper edge 143 and extends at a substantially perpendicular orientation from and to a bottom edge 135 (also illustrated in FIG. 3) of first side wall 134 and a bottom edge 137 (also illustrated in FIG. 3) of second side wall 136. Back wall 131 includes a bottom edge 133 (also illustrated in FIG. 3), a top edge 139 and extends at a substantially perpendicular orientation to bottom edge 135 of first side wall 134 and to bottom edge 137 of second side wall 136. Each of first side wall 134 and second side wall 136 extends back to front between back wall 131 and front wall 132 opposite one another. Back wall 131 includes a pair of female receiving features 145 for receiving fasteners 129 in order to attach base 108 to backer 106. Back wall 131 also includes a pair of lower rails 147, which are elongated protrusions that extend from the front face of back wall 131 and will be discussed in detail below.

In one embodiment, first side wall 134 defines an upper edge 138 (also illustrated in FIG. 3) opposite bottom edge 135 and second side wall 136 defines an upper edge 140 (also illustrated in FIG. 3) opposite bottom edge 137. Upper edges 138 and 140 (also illustrated in FIG. 3) have slopes or curvatures to facilitate reception of a piece of dinnerware, such as an edge or bottom edge of a piece of dinnerware. In addition, first and second side walls 134 and 136 contribute to the overall rigidity of base 108. With the above in mind, product receiving portion 130 is generally formed as an open box.

As illustrated in FIGS. 2 and 3 and in one embodiment, product receiving portion 130 includes a label or sign support member 142 mounted to front wall 132 between upper edge 143 and bottom edge 144. Sign support member 142 is substantially planar and defines a substantially planar display face 146 configured to receive a sign or label having indicia related to the type, style, brand, price, etc. of dinnerware to be displayed by product display fixture 100.

As described above, mounting portion 148 is configured to mount to a backer 106 and to a display unit and includes a main member 152 and a pair of interface members 154 and 156 for interfacing with support elements of a display unit, such as crossbar 300 of a display unit. In particular, the pair of interface members 154 and 156 sit on crossbar 300. Main member 152 includes an upper edge 158, a lower edge 159, a pair of female receiving features 149 and a pair of rails 151.

Lower edge 159 is substantially vertically spaced apart from upper edge 139 of back wall 131 of product receiving portion 130. Main member 152 is substantially planar and laterally centered with respect to product receiving portion 130. The pair of female receiving features 149 receive fasteners 127 in order to attach base 108 to backer 106. The pair of rails 151, like rails 147 on back wall 131 of product receiving portion 130, are elongated protrusions that extend from the front face of main member 152 and will be discussed in detail below.

The pair of interface members 154 and 156 extend backward from main member 152 and include substantially identical substantially horizontal sections 162 and substantially vertical sections 164 that include interior and exterior edges. At the intersection of the interior edges of substantially horizontal sections 162 and main member 152, first corners 165 are formed. At the intersection of interior edges of substantially horizontal sections 162 and the interior edges of substantially vertical sections 164, second corners 166 are formed. Interior edges of substantially vertical sections 164, second corners 166 and interior edges of substantially horizontal sections 162 are configured to receive a crossbar for mounting product display fixture 100 to a display unit.

Elongated spine or channel portion 168 not only receives and supports substantially vertical arm 112 and the pair of substantially horizontal arms 110 and 111, elongated spine or channel portion 168 also connects product receiving portion 130 to mounting portion 148. Elongated spine portion 168 is laterally centered with respect to back wall 131 of product receiving portion 130 and main member 152 of mounting portion 148 and extends from back wall 131 across the space between upper edge 139 of back wall 131 and bottom edge 159 of mounting portion 148. Elongated spine portion 168 includes a first channel 170 having a first end 121, a second end 141 and extends in a substantially vertical direction. First end 121 of first channel 170 receives substantially vertical arm 112. In other words, substantially vertical arm or first adjustable component 112 is insertably engaged with first channel 170 of elongated spine portion 168. Elongated spine portion 168 also includes a second channel 172 (also illustrated in FIG. 3) having a first end 194, a second end 195 and extends in a substantially horizontal direction. First end 194 receives substantially horizontal arm 110 and second end 195 receives substantially horizontal arm 111. In other words, second adjustable component 110 is insertably engaged with second channel 172 and third adjustable component 111 is insertably engaged with second channels 172. Second channel 172 is substantially perpendicular to first channel 170.

In addition, elongated spine portion 168 includes an aperture 173 that extends entirely through the thickness of spine portion 168 and is substantially laterally centered on spine portion 168. Aperture 173 is configured to align with centrally located hole 123 in backer 106 as well as receive multi-functional fastener 125. In this way and as described above, multi-functional fastener 125, among other functions that will be described below, fastens base 108 to backer 106. For example, multi-functional fastener 125 can be a carriage bolt that mates with a washer and wing nut as illustrated in FIG. 3.

Figure 8:
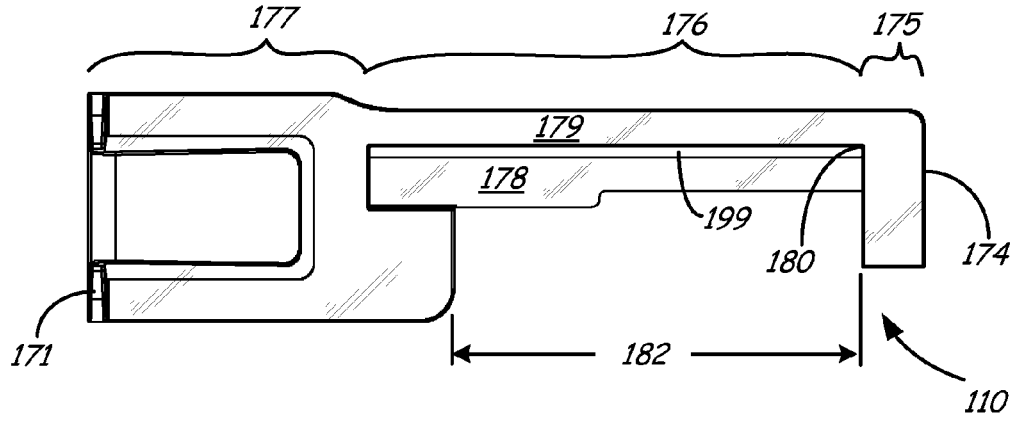
FIG. 8 illustrates a front view of a first substantially horizontal arm of the product display fixture illustrated in FIGS. 2 and 3.
Figure 9:
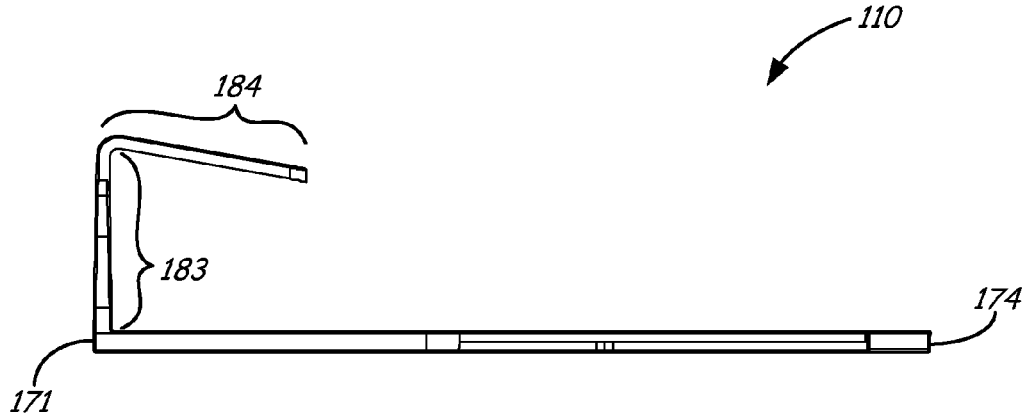
FIG. 9 illustrates a bottom view of FIG. 8.
Figure 10:
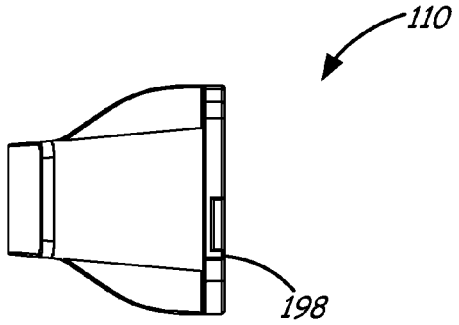
FIG. 10 illustrates a right side view of FIG. 8
Figure 11:
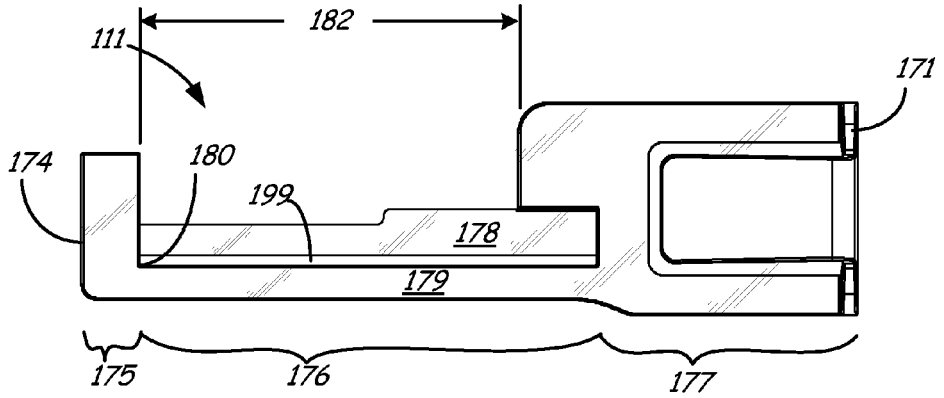
FIG. 11 illustrates a front view of a second substantially horizontal arm of the product display fixture illustrated in FIGS. 2 and 3.
Figure 12:
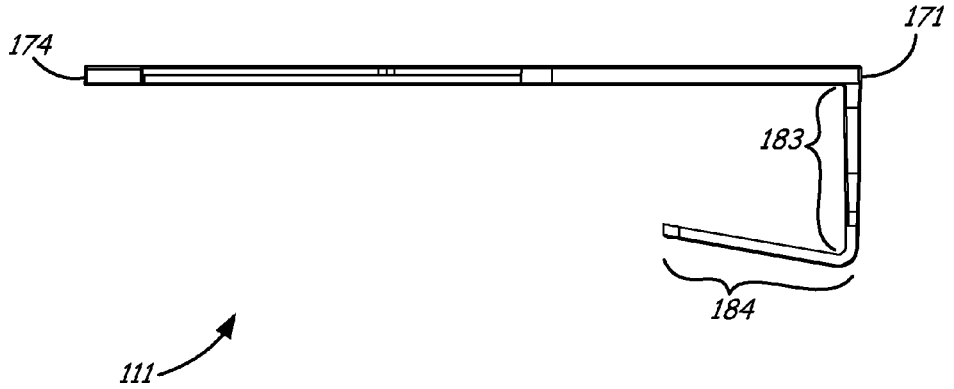
FIG. 12 illustrates a top view of FIG. 11.
Figure 13:
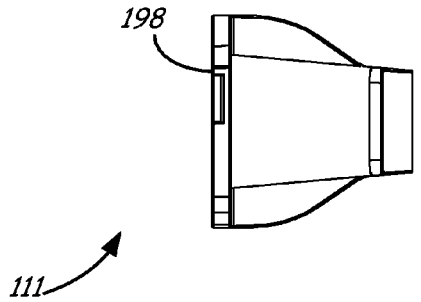
FIG. 13 illustrates a left side view of FIG. 11.

FIG. 8 illustrates a front view, FIG. 9 illustrates a bottom view and FIG. 10 illustrates a right side view of one embodiment of a first substantially horizontal arm or first adjustable component 110 of the pair of substantially horizontal arms or adjustable components 110 and 111. FIG. 11 illustrates a front view, FIG. 12 illustrates a top view and FIG. 13 illustrates a left side view of a second substantially horizontal arm or second adjustable component 111 of the pair of substantially horizontal arms or adjustable components 110 and 111. First substantially horizontal arm 110 and second substantially horizontal arm 111 are substantially identical except in orientation. For example, the bottom of first substantially horizontal arm 110 is the top of second substantially horizontal arm 111 and the left side of first substantially horizontal arm 110 is the right side of second substantially horizontal arm 111.

Each substantially horizontal arm 110 and 111 includes a proximal end 174 and a distal end 171. In FIGS. 8 and 11, proximal end 174 of first substantially horizontal arm 110 is the right side of first substantially horizontal arm 110 and the proximal end 174 of second substantially horizontal arm 111 is the left side of second substantially horizontal arm 111. Distal end 171 of first substantially horizontal arm 110 is the left side of first substantially horizontal arm 110 and distal end 171 of second substantially horizontal arm 111 is the right side of second substantially horizontal arm 111.

More particularly, first substantially horizontal arm 110 and second substantially horizontal arm 111 include proximal sections 175, adjustment sections or portions 176 and clasp sections or product receiving portions 177. Each adjustment section 176 includes a recessed area 178 and a raised area 179. Recessed area 178 includes a through slot 199 that extends entirely through the material of first substantially horizontal arm 110 and second substantially horizontal arm 111 and runs along the intersection between recessed area 178 and raised area 179. Through slot 199 extends from proximal section 175 to clasp section 177. Each proximal section 175 includes a tooth 198 (FIGS. 3, 10 and 13) that extends toward the back of the substantially horizontal arm and an interior shoulder 180 (FIGS. 8 and 12) where raised area of proximal section 176 intersects with slot 199 and proximal section 175.

To interconnect first substantially horizontal arm 110 with second substantially horizontal arm 111, one of the proximal ends 174 of either first substantially horizontal arm 110 or second substantially horizontal arm 111 is inserted through second channel 172 of spine portion 168. Then tooth 198 of first substantially horizontal arm 110 is inserted into through slot 199 on second substantially horizontal arm 111 and tooth 198 of second substantially horizontal arm 111 is inserted into through slot 199 on first substantially horizontal arm. For example, proximal end 174 of first substantially horizontal arm 110 can be inserted into first end 194 of second channel 172 or proximal end 174 of second substantially horizontal arm 111 can be inserted into second end 195 of second channel 172. With teeth 198 inserted into respected through slots 199, proximal section 175 of second substantially horizontal arm 111 is adapted to or configured to slide from interior shoulder 180 of first substantially horizontal arm 110 along recessed area 178 of first substantially horizontal arm 110 for a distance 182. Likewise, proximal section 175 of first substantially horizontal arm 110 is adapted to or configured to sliding from interior shoulder 180 of second substantially horizontal arm 111 along recessed area 178 of second substantially horizontal arm 111 for a distance 182.

Clasp sections 177 of substantially horizontal arms 110 and 111 are located at distal ends 171 and in one embodiment include clasps for gripping an edge of a product, such as an edge of a piece of dinnerware, and having a first clasp portion 183 and a second clasp portion 184. First clasp portion 183 extends forward from distal end 171 and second clasp portion 184 extends substantially inward and slightly angled backward toward the remainder of substantially horizontal arm 110 or substantially horizontal arm 111. First clasp portion 183 is coupled to distal end 171 of each substantially horizontal arm 110 and 111 with suitable give or flexibility such that first clasp portion 183 is allowed to slightly rotate or bend about the intersection between distal end 171 of each substantially horizontal arm 110 and 111 and first clasp portion 183 upon the application of a suitable force to first clasp portion 183. Second clasp portion 184 is similarly formed with suitable give to allow slight rotation or bending about the intersection between first clasp portion 183 and second clasp portion 184 upon the application of sufficient force.

Figure 14:
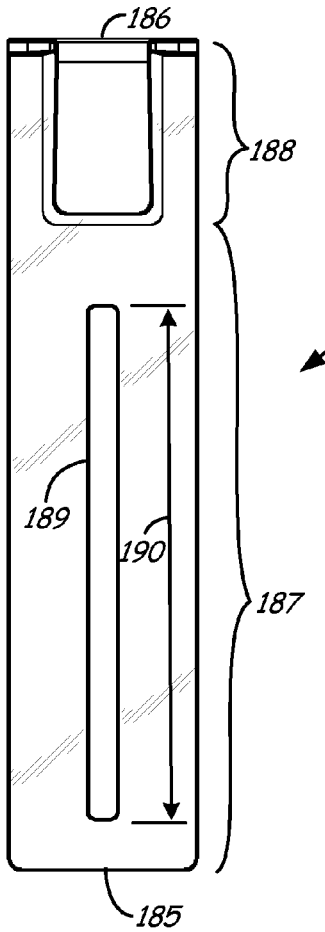
FIG. 14 illustrates a front view of a substantially vertical arm of the product display fixture illustrated in FIGS. 2 and 3.
Figure 15:
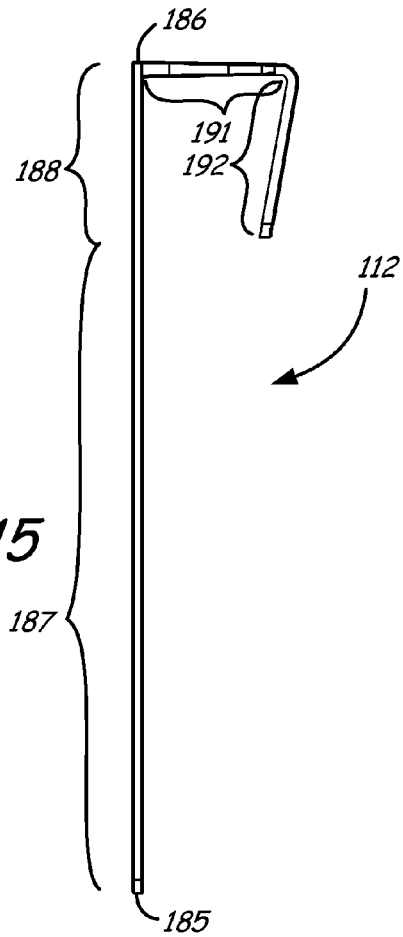
FIG. 15 illustrates a side view of FIG. 14.
Figure 16:
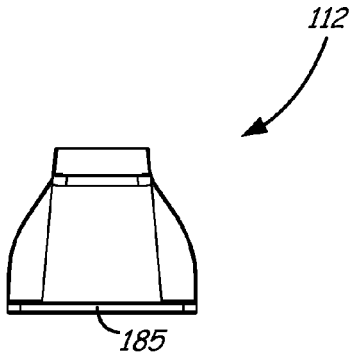
FIG. 16 illustrates a bottom view of FIG. 14.

FIG. 14 illustrates a front view, FIG. 15 illustrates a side view and FIG. 16 illustrates a bottom view of one embodiment of substantially vertical arm 112. Substantially vertical arm 112 includes a proximal end 185 and a distal end 186. Proximal end 185 is the bottom of substantially vertical arm 112 and the distal end 186 is the top of substantially vertical arm 112. Substantially vertical arm 112 includes an adjustment section or portion 187 and a clasp section 188. Adjustment section or portion 187 includes an elongated slot 189 that extends through an entire thickness of substantially horizontal arm 112. Elongated slot 189 spans a distance 190 that is less than a length of adjustment section or portion 187 and does not intersect with proximal end 185 or distal end 186. Clasp section 188 is located at distal end 186 and like clasp section 177 of substantially horizontal arms 110 and 111 includes clasps for gripping an edge of a product, such as an edge of a piece of dinnerware, and having a first clasp portion 191 and a second clasp portion 192. First clasp portion 191 extends forward from distal end 186 and second clasp portion 192 extends substantially inward and slightly angled backward toward the remainder of substantially vertical arm 112. First clasp portion 191 is coupled to distal end 186 with suitable give or flexibility such that first clasp portion 191 is allowed to slightly rotate or bend about the intersection between distal end 186 and first clasp portion 191 upon the application of a suitable force to first clasp portion 191. Second clasp portion 192 is similarly formed with suitable give to allow slight rotation or bending about the intersection between first clasp portion 191 and second clasp portion 192 upon the application of sufficient force.

Adjustment section or portion 187 is configured to be received by first channel 170 of elongated spine portion 168 or adjustment section 187 is configured to be insertably engaged with first channel 170 such that proximal end 185 is located either within first channel 170 or below first channel 170 and distal end 186 is located external to first channel 170. With reference back to FIG. 5, rails 147 and 151 provide a mechanism for substantially vertical arm 112 to ride along and make contact against as it slides between first end 121 and second end 141 in first channel 170. Rails 147 and 151 push substantially vertical arm 112 against the interior of the front side of first channel 170 so that substantially horizontal arms 110 and 111 have ample room to be located behind substantially vertical arm 112 when interconnected together and positioned in second channel 172 or so that substantially vertical arm 112 is prevented from interfering with second channel 172.

Substantially horizontal arms 110 and 111 and substantially vertical arm 112 can be adjusted to accommodate different sized product, such as different sized dinnerware. In particular, adjustment portion 187 of substantially vertical arm 112 operates to slidably adjust within first channel 170 a distance or span between product receiving portion 130 of base 108 and product receiving portion 188 of substantially vertical arm 112. Furthermore, adjustment portion 176 of substantially horizontal arm 110 and adjustment portion 176 of substantially horizontal arm 111 operate to slidably adjust relative to each other within second channel 172 a distance or span between product receiving portion 177 of substantially horizontal arm 110 and product receiving portion 177 of substantially horizontal arm 111.

With reference back to FIGS. 2 and 3, multi-functional fastener 125 performs three primary functions. First, fastener 125 couples substantially horizontal arms 110 and 111 to substantially vertical arm 112. Second, fastener 125 couples substantially horizontal arms 110 and 111 and substantially vertical arm 112 to base 108. Third, fastener 125 couples base 108 to backer 106. In this way, when fastener 125 is tightened, display fixture 100 is adapted to or configured to support a piece of dinnerware for display. When fastener 125 is loosened, substantially horizontal arms 110 and 111 and substantially vertical arm 112 can be adjusted to accommodate various sizes of dinnerware. For example, if a substantially horizontal span between clasp portion 177 on substantially horizontal arm 110 and clasp portion 177 on substantially horizontal arm 111 is too small or too large, fastener 125 can be loosened to spread arms 110 and 111 apart or to push arms 110 and 111 together. Upon retightening, fastener 125 holds the new substantially horizontal span in place. In another example, if a substantially vertical span between clasp portion 188 on substantially vertical arm 112 and fixed product receiving portion 130 is too small or too large, fastener 125 can be loosened to move substantially vertical arm 112. Upon retightening, fastener holds the new substantially vertical span in place.

To adjust product display fixture 100 to accommodate different sized products, the following method is employed. Fastener 125 is loosened. The adjustment portion 187 of the first adjustable component 112 is slid relative to elongated spine portion 168 to adjust a first distance between product receiving portion 130 of fixed component 108 and product receiving portion 188 of first adjustable component 112. The adjustment portion 176 of second adjustable component 110 is slid relative to adjustment portion 176 of third adjustable component 111 and adjustment portion 176 of third adjustable component 111 is slid relative to adjustment portion 176 of second adjustable component 110 to adjust a second distance between product receiving portion 177 of second adjustable component 110 and product receiving portion 177 of third adjustable component 111. Fastener 125 is tightened to couple first adjustable component 112, second adjustable component 110 and third adjustable component 111 to fixed component 108 so that the various components do not move relative to each other.

Before tightening the fastener, a product, such as a piece of dinnerware, can be placed between the product receiving portion of the fixed component and the product receiving portion of the first adjustable component and between the product receiving portion of the second adjustable component and the product receiving portion of the second adjustable component. The first adjustment portion of the first adjustable component is slid relative to the elongated spine portion to engage the product receiving portion of the fixed component and the product receiving portion of the first adjustable component with the product. The adjustment portion of the second adjustable component is slid relative to the adjustment portion of the third adjustable component and the adjustment portion of the third adjustable component is slid relative to the adjustment portion of the second adjustable component to engage the product receiving portion of the second adjustable component and the product receiving portion of the third adjustable component with the product.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display fixture comprising:

a fixed component including a product receiving portion, an elongated spine portion and a mounting portion for mounting the display fixture to a display unit, wherein the elongated spine portion includes a first channel and a second channel that is substantially perpendicular to the first channel;

a first adjustable component insertably engaged with the first channel of the elongated spine portion and including a product receiving portion and an adjustment portion, wherein the adjustment portion operates to slidably adjust a first distance between the product receiving portion of the fixed component and the product receiving portion of the first adjustable component;

a second adjustable component insertably engaged with the second channel of the elongated spine portion and including a tooth located at a proximal end, a product receiving portion located at a distal end and an adjustment portion between the tooth and the product receiving portion, the adjustment portion having a through slot, a recessed area that extends from the through slot to a bottom edge of the adjustment portion of second adjustable component and a raised area that extends from the through slot to a top edge of the adjustment portion of the second adjustable component; and a third adjustable component insertably engaged with the second channel of the elongated spine portion and including a tooth located at a proximal end, a product receiving portion located at a distal end and an adjustment portion, the adjustment portion of the third adjustable component having a through slot, a recessed area that extends from the through slot to a top edge of the adjustment portion of the third adjustable component and a raised area that extends from the through slot to a bottom edge of the third substantially horizontal arm; and wherein the tooth of the second adjustable component mates with and is slidable along the through slot in the third adjustable component and the tooth of the third adjustable component mates with and is slidable along the through slot in the second adjustable component to slidably adjust a second distance between the product receiving portion of the second adjustable component and the product receiving portion of the third adjustable component.

2. The display fixture of claim 1, wherein the product receiving portions of the first adjustable component, the second adjustable component and the third adjustable component comprise clasps that are adapted to grip an edge of a product.

3. The display fixture of claim 1, wherein the product receiving portion of the fixed component comprises a pair of curved edges.

4. The display fixture of claim 1, wherein the mounting portion of the fixed component further comprises at least one interface member adapted to mount to a crossbar of the display unit.

5. A display fixture comprising:

a base including a product receiving portion, a mounting portion and a channel portion connecting the product receiving portion to the mounting portion and having a first channel and a second channel that is substantially perpendicular to the first channel;

a first substantially horizontal arm having a proximal end and a distal end, the proximal end of the first substantially horizontal arm including a tooth, the distal end of the first substantially horizontal arm including a clasp adapted to grip a product for display and between the distal end and the proximal end of the first substantially horizontal arm is an adjustment section having a through slot, a recessed area that extends from the through slot to a bottom edge of the first substantially horizontal arm and a raised area that extends from the through slot to a top edge of the first substantially horizontal arm;

a second substantially horizontal arm having a proximal end and a distal end, the proximal end of the second substantially horizontal arm including a tooth, the distal of the second substantially horizontal arm including a clasp adapted to grip the product for display and between the distal end and the proximal end of the second substantially horizontal arm is an adjustment section having a through slot, a recessed area that extends from the through slot to a top edge of the second substantially horizontal arm and a raised area that extends from the through slot to a bottom edge of the second substantially horizontal arm; and a substantially vertical arm including a proximal end and a distal end, the distal end having a clasp adapted to grip the product for display; and wherein the proximal end of the substantially vertical arm is received by the first channel, the proximal end of the first substantially horizontal arm is received by a first end of the second channel and the proximal end of the second substantially horizontal arm is received by a second end of the second channel; and wherein the tooth of the first substantially horizontal arm mates with and is slidable along the through slot in the second substantially horizontal arm and the tooth of the second substantially horizontal arm mates with and is slidable along the through slot of the first substantially horizontal arm.

6. The display fixture of claim 5, further comprising a fastener that couples the first substantially horizontal arm and the second substantially horizontal arm to the substantially vertical arm.

7. The display fixture of claim 5, further comprising a fastener that couples the first substantially horizontal arm, the second substantially horizontal arm and the substantially vertical arm to the base.

8. The display fixture of claim 5, further comprising a fastener that couples the first substantially horizontal arm, the second substantially horizontal arm, the substantially vertical arm and the base to a backer.

9. The display fixture of claim 5, wherein the base further comprises a mounting portion for mounting to a display unit.

10. The display fixture of claim 9, wherein the mounting portion comprises at least one interface member that sits on a crossbar of the display unit.

11. The display fixture of claim 9, wherein the mounting portion comprises at least one rail for guiding the substantially vertical arm through the first channel and pushing the substantially vertical arm against an interior wall of the first channel.

12. A display fixture comprising:

a fixed component having an elongated spine and a product receiving end, the elongated spine having a first channel and a second channel that is substantially perpendicular to the first channel;

a first adjustable arm having a proximal end, a product receiving distal end, a tooth located at the proximal end, a slot located between the tooth and the product receiving distal end, a recessed area that extends from the slot to a bottom edge of the first adjustable arm and a raised area that extends from the slot to a top edge of the first adjustable arm, wherein the first adjustable arm is slidably engaged with the elongated spine;

a second adjustable arm having a proximal end, a product receiving distal end, a tooth located at the proximal end of the second adjustable arm, a slot located between the tooth and the product receiving distal end of the second adjustable arm, a recessed area that extends from the slot in the second adjustable arm to a top edge of the second adjustable arm and a raised area that extends from the slot to a bottom edge of the second adjustable arm, wherein the second adjustable arm is slidably engaged with the elongated spine;

a third adjustable arm having a proximal end and a product receiving distal end, wherein the third adjustable arm is slidably engaged with the second channel in the elongated spine; and wherein the first and second adjustable arms are slidable within the first channel in the elongated spine to adjust a first distance between the product receiving distal ends of the first and second adjustable arms; and wherein the third adjustable arm is slidable within the second channel in the elongated spine to adjust a second distance between the product receiving distal end of the third adjustable arm and the product receiving end of the fixed component;

wherein a fastener simultaneously couples the first, second and third adjustable arms to the fixed component and sets the first distance between the product receiving distal ends of the first and second adjustable arms and sets the second distance between the product receiving distal end of the third adjustable arm and the product receiving end of the fixed component; and wherein the tooth of the first adjustable arm slides in the slot of the second adjustable arm and the tooth of the second adjustable arm slides in the slot of the first adjustable arm to adjust the first distance between the product receiving distal ends of the first and second adjustable arms.

13. The display fixture of claim 12, wherein the third adjustable arm is slidable along at least one rail so that the third adjustable arm is pushed against a wall of the second channel.

14. The display fixture of claim 12, further comprising a product that is placed between the product receiving end of the fixed component and the product receiving distal end of the third adjustable arm and between the product receiving distal end of the first adjustable arm and the product receiving distal end of the second adjustable arm.

* * * * *